US005924222A

United States Patent [19]

Stoetzer

[11] Patent Number: 5,924,222

[45] Date of Patent: Jul. 20, 1999

[54] TRENCH WALL CUTTER

[75] Inventor: Erwin Stoetzer, Aichach, Germany

[73] Assignee: Bauer Spezialtiefbau GmbH, Schrobenhausen, Germany

[21] Appl. No.: 08/969,610

[22] Filed: Nov. 13, 1997

[30] Foreign Application Priority Data

Dec. 18, 1996 [DE] Germany ..... 196 52 835

[51] Int. Cl.[6] ..... E02F 5/08

[52] U.S. Cl. ..... 37/94; 37/189; 299/86; 405/267

[58] Field of Search ..... 37/94, 189, 190, 37/337, 452, 462; 299/73, 85, 86, 88, 10, 89; 175/81, 94, 355, 122, 364, 373; 173/32, 34, 36, 28, 43

[56] References Cited

U.S. PATENT DOCUMENTS

| | | | |
|---|---|---|---|
| 3,999,616 | 12/1976 | Crane et al. | 173/32 |
| 4,189,186 | 2/1980 | Snyder | 299/31 |
| 4,548,442 | 10/1985 | Sugden et al. | 299/10 |
| 5,035,071 | 7/1991 | Stotzer et al. . | |
| 5,125,719 | 6/1992 | Snyder | 299/31 |
| 5,308,151 | 5/1994 | Sugden et al. | 37/189 X |

*Primary Examiner*—Thomas B. Will
*Assistant Examiner*—Robert Pezzuto
*Attorney, Agent, or Firm*—Sixbey, Friedman, Leedom & Ferguson; David S. Safran; Donald R. Studebaker

[57] ABSTRACT

The invention relates to a trench wall cutter with a cutting frame and a gear shield attached thereto. There is at least one cutting wheel positioned to turn on the opposite shield sides, and on it roller-shaped excavation tools distributed over the periphery are pivotally mounted. When the cutting wheel is rotating the tools form a cutting wheel cutting surface which runs essentially axially parallel to the axis of rotation of the cutting wheel. To accommodate horizontal forces, at least one additional roller is pivotally mounted on each cutting wheel, the axis of the additional roller being directed substantially radially with respect to the axis of rotation of the cutting wheel. One jacket surface of the roller on the radial face side of the cutting wheel away from the gear shield projects in the direction of the axis of rotation of the-cutting wheel.

6 Claims, 2 Drawing Sheets

TRENCH WALL CUTTER

BACKGROUND OF THE INVENTION

1. Field of the Invention

The present invention relates to a trench wall cutter with a cutting frame and a gear shield attached thereto. The wall cutter includes at least one cutting wheel positioned to turn on its opposite shield sides, and on which roller-shaped excavation tools distributed over the periphery thereof are pivotally mounted. When the cutting wheel is rotating the tools form a cutting wheel cutting surface which runs essentially axially parallel to the axis of rotation of the cutting wheel. The trench wall cutting is used to produce trench walls for excavations, seals and foundations.

2. Description of Related Art

U.S. Pat. No. 5,035,071 discloses a trench wall cutter with a cutting frame and gear shield attached thereto. On the opposite shield sides there is at least one cutting wheel each of which can turn, and on which roller-shaped excavation tools are distributed over the periphery thereof and are pivotally mounted thereto. When the cutting wheel is turning the excavation tools form a cutting wheel cutting surface which runs essentially axially parallel to the axis of rotation of the cutting wheel.

Good drilling progress and a good undercut of the cutting wheels can be achieved with this trenched wall cutter even in medium hard to hard rock. When cutting in a trench, excessive forces occur which can lead to so-called "springing" of the entire trench wall cutter in the trench. In this case the cutting wheels are exposed to very high lateral forces which must be transmitted by the lateral, roller-shaped excavation tools to the cutting wheels. In this process considerable wear occurs on the radial bearings of the roller-shaped excavation tools.

SUMMARY OF THE INVENTION

The object of the present invention is to make available a trench wall cutter with roller-shaped excavation tools and with bearings having an especially long service life.

Proceeding from a generic trench wall cutter this is done by providing at least one additional roller being pivotally mounted on each cutting wheel, the axis of the roller being directed substantially radially with respect to the axis of rotation of the cutting wheel, with one jacket surface of the roller on the face side of the cutting wheel away from the gear shield projecting relative to the face in the direction of the axis of rotation of the cutting wheel.

The trench wall cutter of the present invention is provided with that at least one additional roller pivotally mounted on each cutting wheel, the axis of the roller extending substantially radially with respect to the axis of rotation of the cutting wheel, with one jacket surface of the roller on the face side of the cutting wheel away from the gear shield projecting relative to the face in the direction of the axis of rotation of the cutting wheel.

The arrangement of these additional rollers laterally guides and supports the trench wall cutter in the trench slot. When the trench wall cutter "springs" the lateral forces which occur are absorbed by these rollers. The roller-shaped excavation tools are subsequently relieved of the lateral forces so that hardly any axial forces act on the radial bearings of the excavation tools. By reducing the axial forces which especially load the radial bearings a considerable reduction of the wear on these bearings is achieved. This reduces maintenance costs and increases the length of operation of the trench wall cutter.

The roller can basically be made with a smooth jacket surface which leads to the desired sealing of the side wall of the trench slot. In accordance with one preferred embodiment of the present invention, the roller is provided with excavation means such as cutting teeth. The roller is likewise made as an excavation tool for breaking the soil. Thus a slot with accurately defined walls can be formed. Especially good drilling progress can be achieved by utilizing roller bits as the excavating tools.

According to another embodiment of the present invention it is advantageous that the excavation tools are made in the shape of truncated cones. According to the angle of the cone the respective axis of rotation of the roller-shaped excavation tool can be angled from an axially-parallel location to the axis of rotation of the cutting wheel so that by means of the excavation tools, as the cutting wheel rotates, a cutting wheel cutting surface is furthermore formed which runs axially parallel to the axis of rotation of the cutting wheel. When the axis of rotation of the roller-shaped excavation tools is angled, their radial bearings to a certain extent can better withstand lateral forces. The roller thus extends laterally as far away from the gear shield as the laterally external excavation tools.

Another embodiment of the present invention includes providing a total of four rollers on one cutting wheel, distributed at given angular distances over the cutting wheel. By means of the arrangement of several rollers the load on the individual rollers is reduced. Preferably the rollers are offset at an angle of 60 and 120 degrees to one another at a uniform angular distance or alternately.

For especially good force distribution with good drilling performance it is advantageous that there are a total of four cutting wheels, of which two are located on one shield side.

These and further objects, features and advantages of the present invention will become apparent from the following description when taken in connection with the accompanying drawings which, for purposes of illustration only set forth a single embodiment in accordance of the present invention.

DETAILED DESCRIPTION OF THE PREFERRED EMBODIMENT

Figure 1:
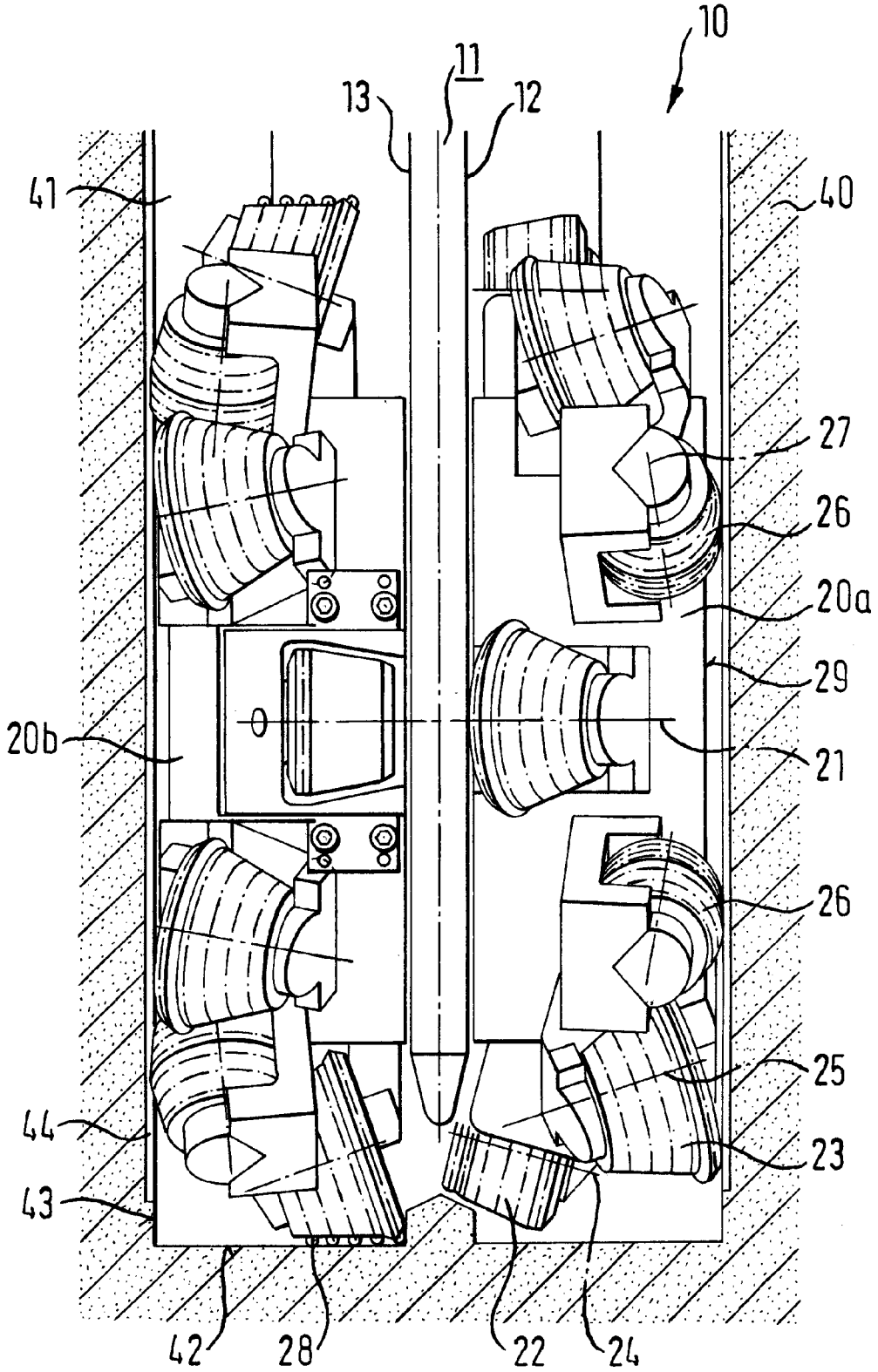
FIG. 1 shows a partial side view of a trench wall cutter in accordance with the present invention positioned in a trench.

FIG. 1 shows a schematic illustration of the trench wall cutter 10 in accordance with the present invention with a gear shield 11 composed of two shield walls 12 and 13. Gear shield 11 is attached in the conventional manner to a cutting frame which is not shown. This cutting frame being similar to that disclosed in above mentioned U.S. Pat. No. 5,035,071, the contents of which are hereby incorporated by reference. On either side of gear shield 11 are cutting wheels 20*a* and 20*b* each of which are rotationally driven by a conventional drive means about an axis of rotation 21 which extends substantially perpendicular to the gear shield 11.

To remove soil 40 when forming the trench 41, each cutting wheel 20*a*, 20*b* include inner roller bits 22 and outer roller bits 23 in the form of excavation tools. The inner roller bits 22 and outer roller bits 23 have roller bodies in the shape of truncated cones with excavation means 28 attached to the truncated surface.

Figure 2:
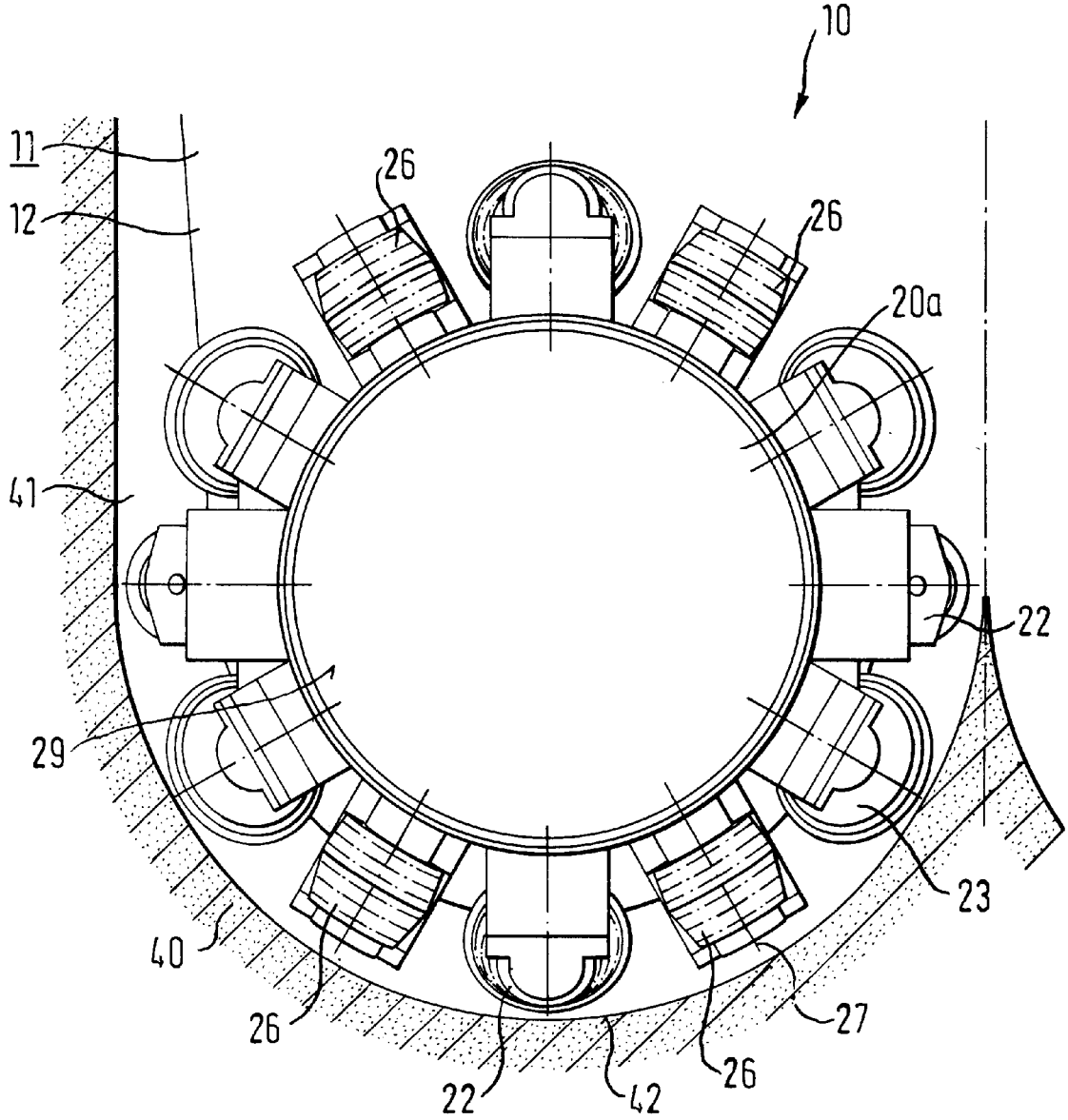
FIG. 2 shows a front view of the trench wall cutter shown in FIG. 1.

As is apparent from FIG. 2, inner roller bits 22 and outer roller bits 23 are pivotally secured to the periphery of cutting wheels 20*a*, 20*b* by means of holders, each holder being diametrically opposed to another holder. Axes 24 of the inner roller bits 22 and axes 25 of outer roller bits 23 are substantially axially parallel to the axis of rotation 21 of cutting wheel 20*a*, 20*b*, depending on the conical angle of the truncated cone-shaped bodies of inner roller bits 22 or outer roller bits 23, the axis of rotation may be slightly angled. The angle setting is chosen such that as cutting wheels 20*a*, 20*b*, rotate roller bits 22, 23 form a ground-contacting cutting wheel cutting surface which runs essentially axially parallel to the axis of rotation 21 of cutting wheel 20*a*, 20*b*. The contact surfaces of the enveloping surfaces of outer roller bits 23 and the enveloping surface of trench 41 are essentially parallel to one another and parallel to the axis of rotation 21 of cutting wheels 20*a*, 20*b*.

To avoid loading the radial bearings of roller bits 22, 23 by horizontally directed forces which can occur in the so-called "springing" of the trench wall cutter in trench 41, rollers 26 are supported on each cutting wheel 20*a*, 20*b* adjacent their outer face sides 29. The roller axes 27 of the rollers 26 are directed substantially radially to the axis of rotation 21 of cutting wheel 20*a*, 20*b* and parallel to shield walls 12, 13 of gear shield 11.

Rollers 26 are attached via corresponding holders arranged diametrically opposed to one another on the roller wheel hub such that one jacket surface of rollers 26 projects horizontally farther away from gear shield 11 than the peripheral surface of outer roller bits 23. Therefore while outer roller bits 23 first cut a slot at a given width with side wall 43, rollers 26 are provided to form a widened area 44. The widened area 44 is dependent on how far rollers 26 project relative to the outer roller bits 23. In the embodiment shown, rollers 26 themselves are provided with excavation devices such as cutting teeth which are shown only schematically.

On each cutting wheel 20*a*, 20*b* there are four rollers 26 for accommodating the lateral forces. A total of four rollers 26 are distributed alternatingly at an angular distance of 60 and 120 degrees over the periphery of cutting wheel 20*a*, 20*b*. This arrangement is the same in the opposing cutting wheels 20*a*, 20*b*, opposing cutting wheels 20*a*, 20*b* being arranged adjacent to one another on axis of rotation 21 in order to ensure especially good support of the trench wall cutter 10 in the trench 41. Although only two cutting wheels 20*a*, 20*b* are shown, the described embodiment of the present invention may have a total of four cutting wheels which are located next to one another in pairs.

By the arrangement of additional rollers 26 with contact surfaces of the enveloping surfaces with the enveloping surface of the trench 41 running essentially parallel to side wall 43 of trench 41, advantageous apportionment of forces on cutting wheels 20*a*, 20*b* is achieved. Thus, the horizontal forces are accommodated by rollers 26, while vertical forces are accommodated mainly by outer roller bits 23.

While a single embodiment in accordance with the present invention has been shown and described, it is noted that the invention is not limited thereto, and is susceptible to numerous changes and modifications as appreciated by those skilled in the art. Therefore, this invention is not limited to the details shown and described herein, and includes all such changes and modifications as are encompassed by the scope of the appended claims.

I claim:

1. A trench wall cutter comprising:

a cutting frame having a gear shield attached thereto;

at least two cutting wheels at least one each of said cutting wheels being rotatably positioned on opposing sides of the gear shield, each of said cutting wheels including a plurality of pivotally mounted roller-shaped excavation tools distributed about a periphery of each of the cutting wheels; and at least one additional roller pivotally mounted on each of said cutting wheels, an axis of rotation of the additional roller extending substantially radially with respect to an axis of rotation of the cutting wheel;

wherein the excavation tools of the cutting wheels form a cutting wheel cutting surface when the cutting wheels rotate which extends substantially axially parallel to an axis of rotation of the cutting wheel, and a jacket surface of the additional roller on one face side of each of said cutting wheels away from said gear shield projects outwardly relative to the face side in the direction of the axis of rotation of the cutting wheel.

2. A trench wall cutter as claimed in claim 1, wherein the additional rollers is provided with excavation means.

3. A trench wall cutter as claimed in claim 1, wherein the excavation tools are roller bits.

4. A trench wall cutter as claimed in claim 1, wherein the excavation tools are in the form of truncated cones.

5. A trench wall cutter as claimed in claim 1, wherein there are a total of four additional rollers on the cutting wheel, said additional rollers being distributed at predetermined angular distances about the periphery of the cutting wheel.

6. A trench wall cutter as claimed in claim 1, wherein there are a total of four additional rollers, with two additional rollers being located on one shield side.

* * * * *